US008910938B2

(12) United States Patent
Sunohara

(10) Patent No.: US 8,910,938 B2
(45) Date of Patent: Dec. 16, 2014

(54) MEDIUM CARRYING DEVICE AND IMAGE FORMING APPARATUS

(71) Applicant: Oki Data Corporation, Tokyo (JP)

(72) Inventor: Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/138,617

(22) Filed: Dec. 23, 2013

(65) Prior Publication Data

US 2014/0175739 A1 Jun. 26, 2014

(30) Foreign Application Priority Data

Dec. 26, 2012 (JP) ..... 2012-282377

(51) Int. Cl.

| | |
|---|---|
| ***B65H 7/02*** | (2006.01) |
| ***B65H 7/20*** | (2006.01) |
| ***B65H 5/06*** | (2006.01) |
| ***B65H 7/06*** | (2006.01) |
| ***B65H 9/00*** | (2006.01) |

(52) U.S. Cl.

CPC ..... *B65H 7/20* (2013.01); *B65H 5/068* (2013.01); *B65H 7/06* (2013.01); *B65H 9/002* (2013.01)

USPC ..... 271/265.01; 271/258.01

(58) Field of Classification Search

CPC ..... B65H 7/02; B65H 7/14

USPC ..... 271/265.01, 258.01

See application file for complete search history.

(56) References Cited

U.S. PATENT DOCUMENTS 7,300,055 B2 * 11/2007 Mukai ..... 271/272
7,593,683 B2 * 9/2009 Kim et al. ..... 399/388

FOREIGN PATENT DOCUMENTS

JP 10-291662 A 11/1998

* cited by examiner

*Primary Examiner* — Michael McCullough

(74) *Attorney, Agent, or Firm* — Muncy, Geissler, Olds & Lowe, P.C.

(57) ABSTRACT

A medium carrying device includes a first pair of rollers that forms a nip part and carries a medium, the nip part being defined as an area where the rollers contact each other applying a pressure to other, a guide part that guides the medium to the first pair of rollers, and a medium detection member that includes a tip end part and a pivoting fulcrum and that is pivoted around the pivoting fulcrum by the medium as the medium moves along the guide part. In a case of being viewed from a roller axial direction of the first pair of rollers, the tip end part passes the nip part when the medium detection member pivots around the pivoting fulcrum as a center.

8 Claims, 7 Drawing Sheets

MEDIUM CARRYING DEVICE AND IMAGE FORMING APPARATUS

CROSS REFERENCE TO RELATED APPLICATION

The present application is related to, claims priority from and incorporates by reference Japanese Patent Application No. 2012-282377, filed on Dec. 26, 2012.

TECHNICAL FIELD

The present application relates to a medium carrying device that carries a medium and an image forming apparatus that uses the medium carrying device.

BACKGROUND

Conventionally, as a medium carrying device used in an image forming apparatus such as an electrographic photocopy machine, facsimile, printer, and multi-function peripheral, a carrying device using a pair of rollers is known. For example, in JP Laid-Open Patent Application No. H10-291662, an example is disclosed that a document front-end and rear-end detection sensor is arranged for detecting a medium in a carrying device.

However, in the case where a higher speed of a medium carrying speed of the apparatus is required, it is required to accurately detect an end part of a carried medium.

The present invention has been invented, considering such situation. Purposes of the present invention are to increase a detection accuracy of the end part of the medium, and thereby to provide a medium carrying device and an image forming apparatus that are available for the higher speed of the medium carrying speed of the apparatus as well.

A medium carrying device disclosed in the application includes a first pair of rollers that forms a nip part and carries a medium, the nip part being defined as an area where the rollers contact each other applying a pressure to other, a guide part that guides the medium to the first pair of rollers, and a medium detection member that includes a tip end part and a pivoting fulcrum and that is pivoted around the pivoting fulcrum by the medium as the medium moves along the guide part. In a case of being viewed from a roller axial direction of the first pair of rollers, the tip end part passes the nip part when the medium detection member pivots around the pivoting fulcrum as a center.

According to the present invention, it is possible to increase a detection accuracy of the end part of the medium, and thereby it is possible to provide a medium carrying device and an image forming apparatus that are available for the higher speed of the medium carrying speed of the apparatus as well.

DETAILED DESCRIPTION OF EMBODIMENTS

Figure 1:
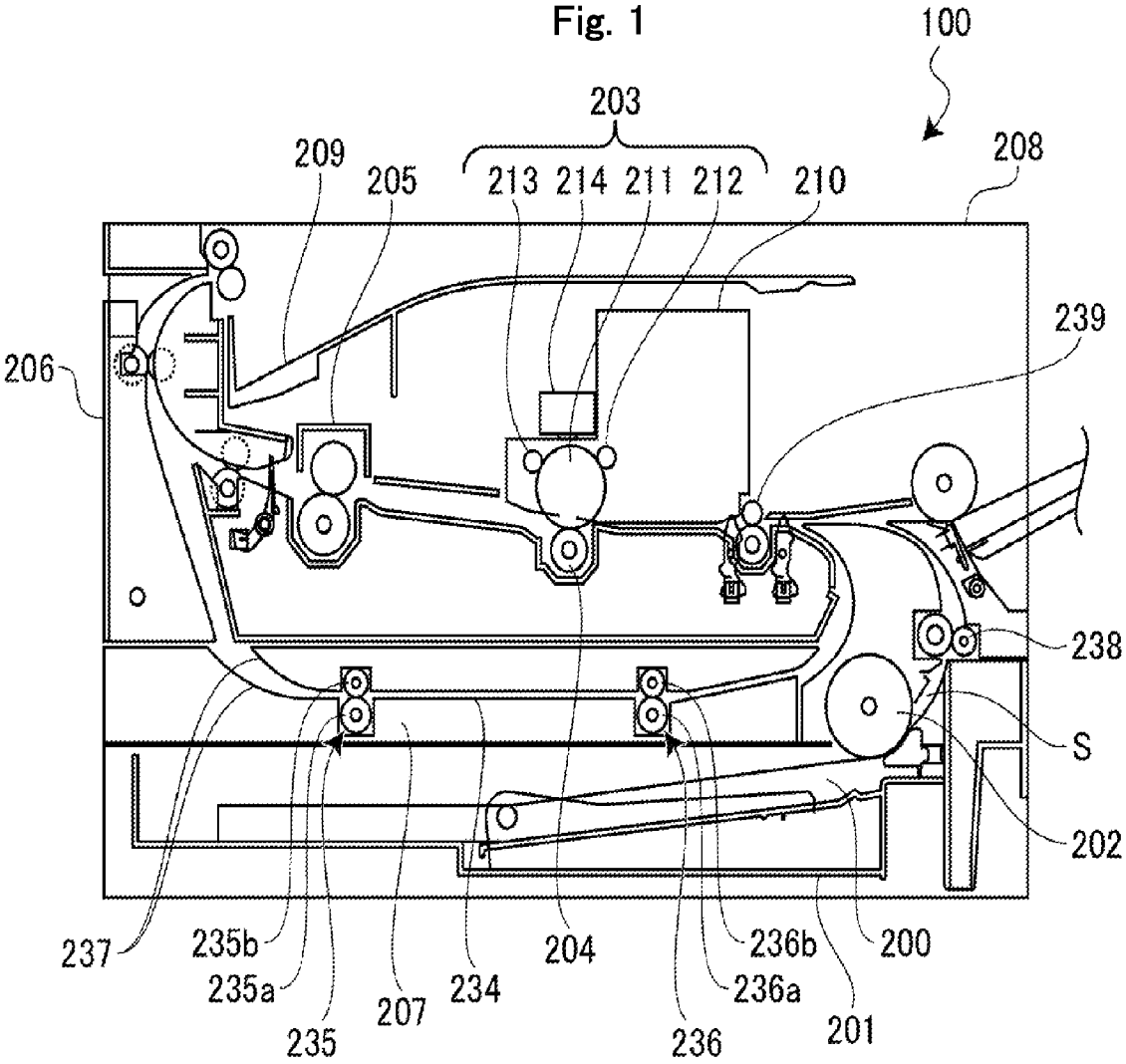
FIG. 1 is a side cross view that illustrates a whole structure of an image forming apparatus.

Hereinafter, explanation of embodiments of the present invention is given, referring to the drawings. Note, the present invention is not limited to the description given hereafter and can be arbitrarily modified within the range without departing from the scope of the present invention.

First Embodiment

FIG. 1 is a side cross view that illustrates a whole configuration of an image forming apparatus 100 according to a first embodiment of the present invention. The image forming apparatus 100 forms an image on a sheet 200 as a medium by an electrographic method based on image data transmitted from an external terminal such as a computer.

The image forming apparatus 100 includes a sheet supply cassette 201, a sheet supply unit 202, a carrying roller 238, a carrying roller 239, an image forming part 203, a transferring roller 204, a fusion unit 205, a sheet ejection unit 206, a both side carrying unit 207 and a sheet stacking part 209 along a medium carrying path S of which a start point is the sheet supply cassette 201 and an end point is the sheet stacking part 209.

The sheet supply cassette 201 contains sheets 200 inside in a layered manner, and is removably attached to a bottom part of the image forming apparatus 100. Then, the sheet supply unit 202 attached to an upper part of the sheet supply cassette 201 supplies sheets 200 one by one from the uppermost part of the sheets 200 contained in the sheet supply cassette 201 to the medium carrying path S.

The carrying roller 238 and the carrying roller 239 correct the skew of each of the sheets 200 fed from the sheet supply unit 202, and hold and carry the sheet 200 to the image forming part 203.

The image forming part 203 includes a photoreceptor 211 as an image carrier, a development unit 212, a charger 213, and an optical unit 214.

The photoreceptor 211 is configured with a conductive supporter and a photo-conductive layer, and is, for example, an organic photoreceptor that is configured by sequentially laminating a charge generation layer and a charge transportation layer as the photo-conductive layer on a metal shaft made of aluminum or the like as the conductive supporter. Also, the photoreceptor 211 forms an electrostatic latent image based on light irradiated from the optical unit 214 as the photoreceptor 211 rotates in a predetermined direction.

The development unit 212 includes at least a development roller (not illustrated), a supply roller, a development blade, and the like. The development roller closely contacts the photoreceptor 211, and forms a toner image by supplying toner as a developer to an electrostatic latent image formed on the surface of the photo receptor 211. The supply roller supplies toner to the development roller. The development blade is provided to directly contact the development roller and regulates a layer thickness of toner supplied by the supply roller.

The charger 213 is configured as a roller member formed by a metal shaft made of stainless or the like and a semiconductive epichlorohydrin rubber. The charger 213 directly contacts the photoreceptor 211 with a predetermined amount of pressure, and charges evenly the entire surface of the photoreceptor 211 based on charge bias applied from a high voltage power source (not illustrated).

The optical unit 214 is a light emitting diode (LED) head that LED elements are arrayed in an axial direction of the photoreceptor 211, and irradiates the surface of the photoreceptor 211 with radiation light based on image data. The optical unit 214 is arranged such that the radiation light radiating when the LED elements emit light is to be positioned on an image forming position on the surface of the photoreceptor 211. Note, as the optical unit 214, a laser scanning unit including a laser radiation part and a polygon mirror may be used.

Note, the photoreceptor 211, the development unit 212, and the charger 213, which are described above, are held by an image drum cartridge 210. The image drum cartridge 210 includes a containing space that contains toner and a supply system (not illustrated) that supplies the toner contained in the containing space to the development unit, and is configured to be removably attached to the image forming apparatus 100.

The transferring roller 204 is made of, for example, conductive rubber, or the like. In a situation where the transferring roller 204 directly contacts the photoreceptor 211, the transferring roller 204 transfers a toner image to the sheet 200, the toner image being formed on the surface of the photoreceptor 211 based on the application voltage applied from the high voltage power source (not illustrated).

The fusion unit 205 is provided on a downstream side of the medium carrying path S, which is located on the downstream side with respect to the image forming part 203, and includes a heat roller 241, a backup roller 241, and a thermistor (not illustrated), and the like. The heat roller 241 is formed by covering a core shaft in a hollow cylinder shape made of aluminum or the like with a heat resistant elastic layer made of silicone rubber and covering the heat resistant elastic layer with a PFA (copolymer of tetrafluoroethylene and perfluorovinylether) tube. Then, in the core shaft, a heating heater such as a halogen lump, for example, is provided. The backup roller 240 is configured by covering a core shaft made of aluminum or the like with a heat resistant elastic layer made of silicone rubber and covering the heat resistant elastic layer with a PFA tube, and is arranged so as to form a contact and press part between the heat roller 241 and the backup roller 240. The thermistor is a surface temperature detection system for the heat roller 241, and is provided near the heat roller 241 so as not to directly contact the heat roller 241. When the heating heater, which has been described above, is controlled based on detection results of the surface temperature of the heat roller 241 detected by the thermistor, the surface temperature of the heat roller 241 is maintained to be a predetermined temperature. When the sheet 200 to which the toner image formed in the image forming part 203 is transferred pass through between the heat roller 241 maintained to have a predetermined temperature and the backup roller 240, heat and pressure are applied to the toner on the sheet 200, so that the toner melts and the toner image is fused.

The sheet ejection unit 206 carries the sheet 200 passed through the fusion unit 205 to the sheet stacking part 209 formed by using an outside of the case that is an apparatus main body 208 or the both side carrying unit 207 formed in the apparatus main body 208. A configuration of the sheet ejection unit 206 is to be described below.

The both side carrying unit 207 includes a pair of both side carrying rollers 235 that includes a pair of rollers that includes a roller 235*a* and a pressure roller 235*b*, a pair of both side carrying rollers 236 that includes a pair of rollers that includes a roller 236*a* and a pressure roller 236*b*, and a carrying guide 237. Furthermore, the both side carrying unit 207 is arranged under the image forming part 203, is formed in parallel to the medium carrying path S between the carrying roller 239 and a pair of sheet ejection rollers 215 of the sheet ejection unit 206, which is described later, and has an inversion path 234 extending from the carrying guide 237. On the inversion path 234, the pair of both side carrying roller 235 and the pair of both side carrying roller 236, which are rotated and driven by a motor (not illustrated), are arranged. When the pairs of both side carrying rollers are rotated and driven, the sheet 200 of which upper surface is a surface on which a toner image is formed is reversed such that the upper surface and its undersurface of the sheet 200 are reversed just before the sheet 200 reaches the carrying roller 239, and then the sheet 200 is carried again to the image forming part 203 in a state where the surface on which the toner image is formed is an undersurface.

Figure 2:
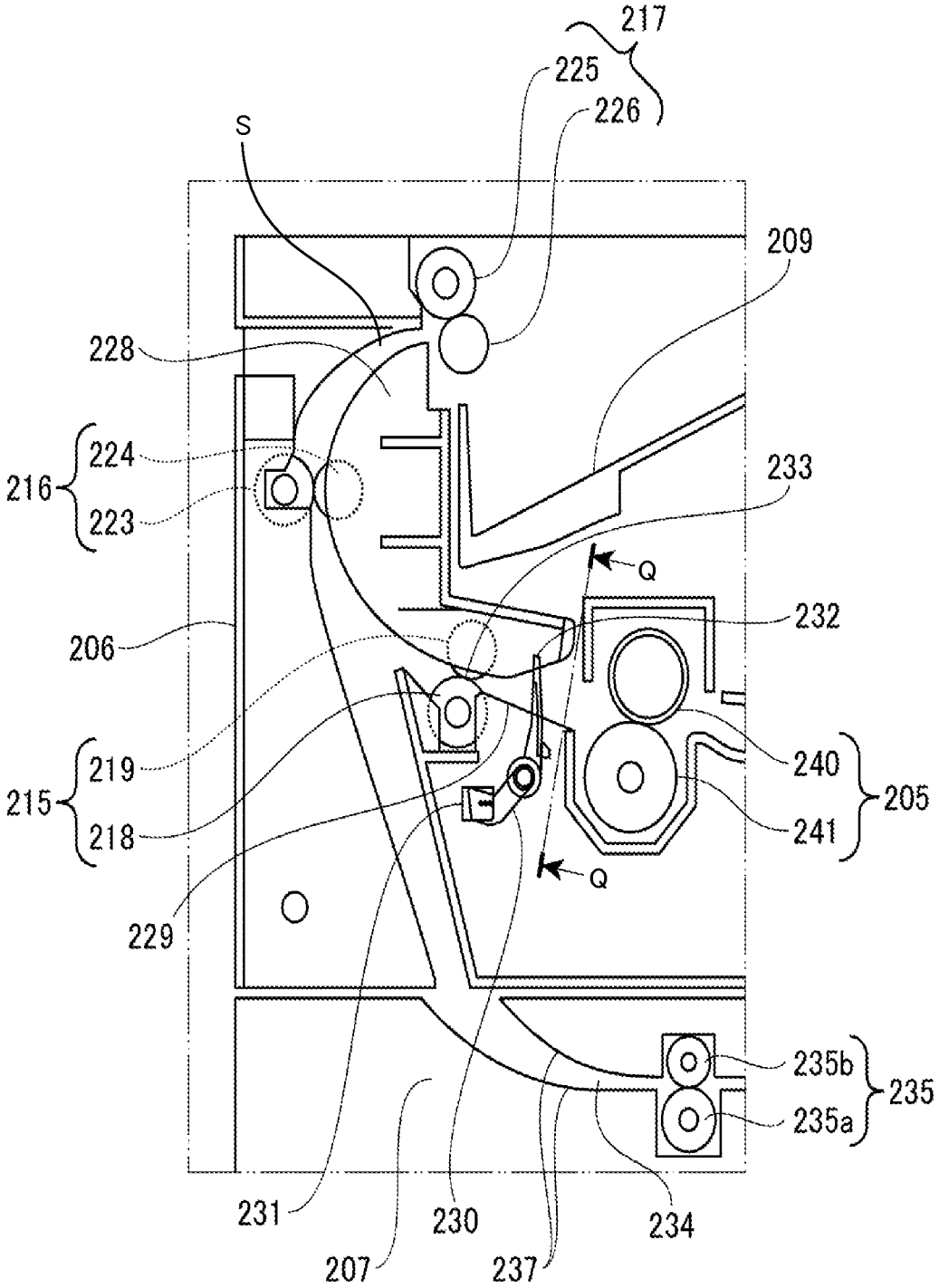
FIG. 2 is a side cross view that illustrates one portion of a sheet ejection unit.
Figure 3:
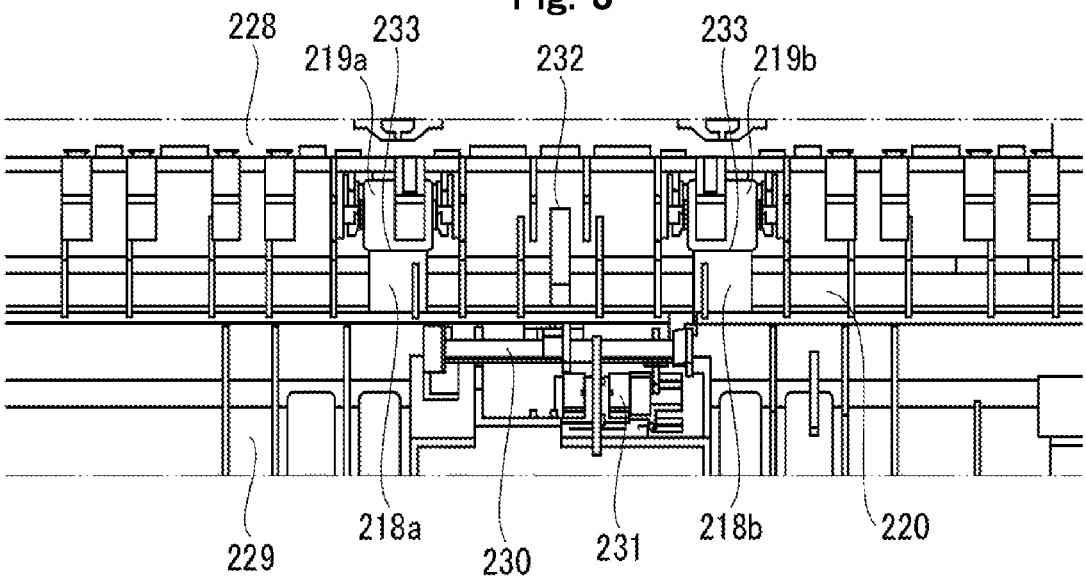
FIG. 3 is a circumferential view of one portion of the sheet ejection unit, seen from Q-Q direction of FIG. 2.

FIG. 2 is a side cross view that illustrates one portion of the sheet ejection unit 206 according to the present embodiment. FIG. 3 is a circumferential view of one portion of the sheet ejection unit 206, seen from the Q-Q direction of FIG. 2.

The sheet ejection unit 206 includes a pair of sheet ejection rollers 215 as a first roller pair, a pair of sheet ejection rollers 216, and a pair of sheet ejection rollers 217. The pair of sheet ejection rollers 215 is configured with a sheet ejection roller 218 as a first roller and a pressure application roller 219 as a second roller provided to face the sheet ejection roller 218. Furthermore, the sheet ejection roller 218 includes a shaft 220, a roller 218*a* that is attached to the shaft 220 and has a longitudinal direction length X1 in the rotation axial direction, and a roller 218*b*. In the description of the present embodiment, a roller of the pressure application roller 219, which is provided to face the roller 218*a* and has the same longitudinal direction length as that of the roller 218*a*, is designed as a pressure application roller 219*a*, and a roller of the pressure application roller 219, which is provided to face the roller 218*b* and has the same longitudinal direction length as that of the roller 218*b*, is designed as a pressure application roller 219*b*. The sheet ejection roller configured of the roller 218*a* and the roller 218*b* is configured as an elastic body made of such as rubber, and the pressure application roller 219 configured of the pressure application roller 219*a* and the pressure application roller 219*b* is configured as a rigid body such as plastic. The Young's modulus of the sheet ejection roller 218 is lower than the Young's modulus of the pressure application roller 219. Here, the sheet ejection roller 218 is a driving roller and the pressure application roller 219 is a driven roller.

The pair of sheet ejection rollers 216 is configured of a sheet ejection roller 223 and a pressure application roller 224 provided to face the sheet ejection roller 223. The pair of sheet ejection rollers 217 is configured of a sheet ejection roller 225 and a pressure application roller 226 provided to face the sheet ejection roller 225. The sheet ejection roller 218, the sheet ejection roller 223, and the sheet ejection roller 225 are enable to rotate in a forward direction or a reverse direction in response to the driving of an ejection motor (not illustrated) in the forward direction or the reverse direction. In other word, at the time of forming images on both sides of the sheet 200, the pair of the sheet ejection rollers 216 and the pair of the sheet ejection rollers 217 function as return members that send the sheet 200 to the inversion path 234. In this case, when the pair of sheet ejection rollers 216 and the pair of sheet ejection rollers 217 rotate in the forward direction, the sheet 200 that has passed through the fusion unit 205 is carried toward the sheet stacking part 209, and when the pair of sheet ejection rollers 216 and the pair of sheet ejection rollers 217 rotate in the reverse direction just before that the sheet 200 is about to be ejected, the sheet 200 is sent to the inversion path 234. Note, the forward direction in the present embodiment means a rotation direction for carrying the sheet 200 toward the sheet stacking part 209 in FIG. 2, and the reverse direction means a rotation direction for carrying the sheet 200 to the inversion path 234, namely to the both side carrying unit 207.

Also, the pressure application roller 219*a* and the pressure application roller 219*b* are supported by the carrying guide 228 at their shaft, and are given pressure toward the sheet ejection roller 218, namely toward the roller 218*a* and the roller 218*b*, by a pressure application member (not illustrated). Furthermore, the pressure application roller 224 is supported by the carrying guide 228 at its shaft, and applies pressure to the ejection roller 223 with a pressure application member (not illustrated). Also, the pressure application roller 226 is supported by the carrying guide 228 at its shaft, and applies pressure toward the sheet ejection roller 225 with a pressure application member (not illustrated).

Figure 4:
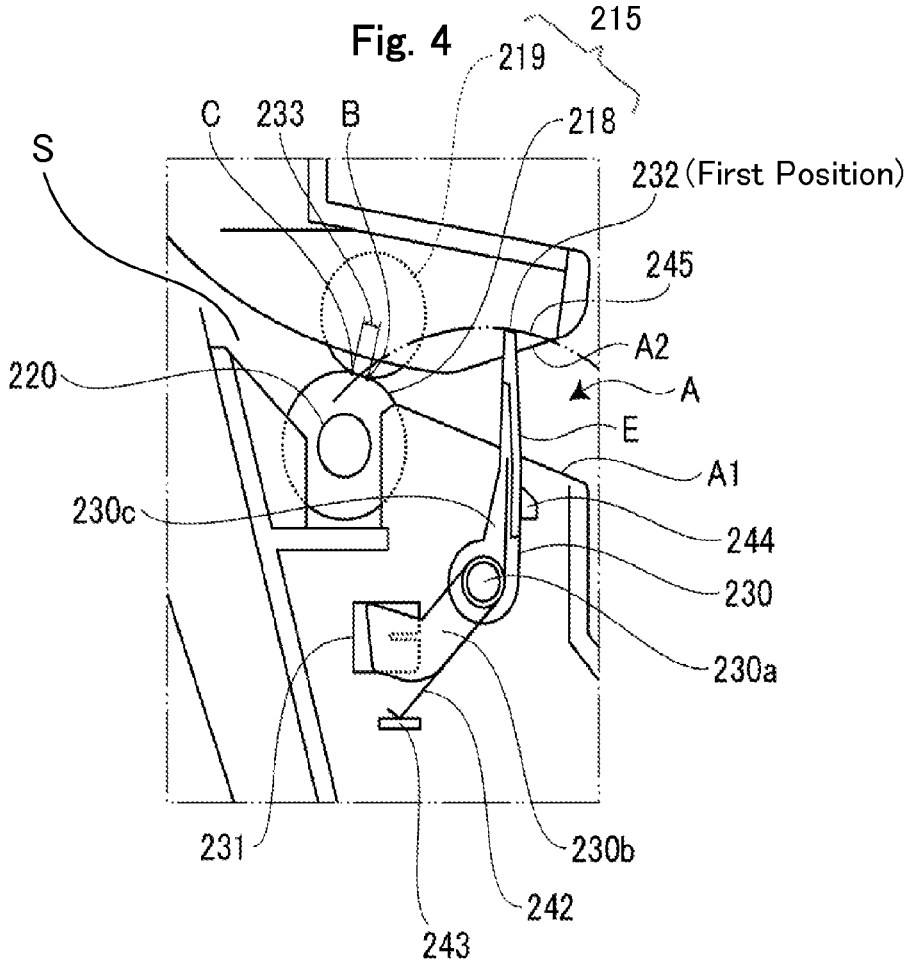
FIG. 4 is a partially enlarged view that explains a configuration of a sensor lever.

Herein, a configuration of a sensor lever 230 as a medium detection member is explained referring to FIGS. 2-4. FIG. 4 is a partially enlarged view that explains the configuration of the sensor lever 230, and is a view of a vicinity of the sheet ejection unit 206 in a state where the sheet 200 is not being carried, the view seen from the rotation axial direction of the sheet ejection roller 218. The sensor lever 230 is arranged on an upstream side of the pair of sheet ejection rollers 215 along the medium carrying path S, and is supported by a carrying guide 229 at its shaft. The sensor lever 230 arranged in such position includes a fulcrum part 230*a*, an arm part 230*c*, and a shielding part 230*b* that extends from the fulcrum part 230*a* toward a side opposite to a side that the arm part 230*c* is formed. The arm part 230*c* includes a tip end part 232 and a direct contact part E that is formed between the fulcrum part 230*a* and the tip end part 232. The direct contact part E is arranged to position in an upstream side of the medium carrying direction so as to face the carried sheet 200.

A guide A is a member that guides the sheet 200 from the fusion unit 205 toward the pair of sheet ejection roller 215 along the medium carrying path S, and includes a carrying surface A1 of the carrying guide 229 that is provided on the sheet ejection roller 218 side and a carrying surface A2 of the carrying guide 228 that is provided on the pressure application roller 219 side, the carrying surface A2 facing the carrying surface A1. In the situation where the sheet 200 is not being carried, the sensor lever 230 is arranged such that a tip end part 232 thereof projects from the carrying surface A1 as illustrated in FIG. 4. As described above, in the sensor lever 230, the tip end part 232 and a direct contact part E that is formed extending between the fulcrum part 230*a* and the tip end part 232 are formed, and the sensor lever 230 is configured such that the direct contact part E extends from the carrying surface A1 side to the carrying surface A2 side in the situation where the sheet 200 is not carried. When the sheet 200 contacts the direct contact part E, the sensor lever 230 starts to pivot around the fulcrum part 230*a* as its center. In the present embodiment, the tip end part 232 of the sensor lever 230 is configured to pass through a nip part 233 between the sheet ejection roller 218 and the pressure application roller 219 in response to the contact to the sheet 200. Note, the tip end part 232 of the sensor lever 230 contacts the rear end of the sheet 200 when the sheet 200 passes through the pair of sheet ejection rollers 215.

A photocoupler 231 that detects rotation of the sensor lever 230 is attached to the carrying guide 229. The sensor lever 230 shades a sensor part of the photocoupler 231 from light when the sheet 200 doesn't exist. Also, a torsion sprint 242 is attached to the sensor lever 230. The torsion sprint 242 is arranged such that an end side thereof contacts a rib 243 formed in the carrying guide 229. The sensor lever 230 is biased in an anticlockwise direction in the drawing, and thereby the arm part 230*c* directly contacts a stopper 244 of the carrying guide 229.

Note, the nip part 233 according to the present embodiment covers a region where the sheet ejection roller 218 and the pressure application roller 219 contact each other, which configure the pair of sheet ejection rollers 215. Specifically, as illustrated in FIG. 4, the nip part 233 covers a region from a direct contact part B to a direct contact part C, the direct contact part B being from the sheet ejection roller 218 to the pressure application roller 219 on the medium carrying direction most upstream side of the medium carrying path S, the direct contact part C being from the sheet ejection roller 218 to the pressure application roller 219 on the medium carrying direction most downstream side of the medium carrying path S. At this time, because the shielding part 230*b* of the sensor lever 230 shields the photocoupler 231, sheet detection by the photocoupler 231 is off.

Figure 5:
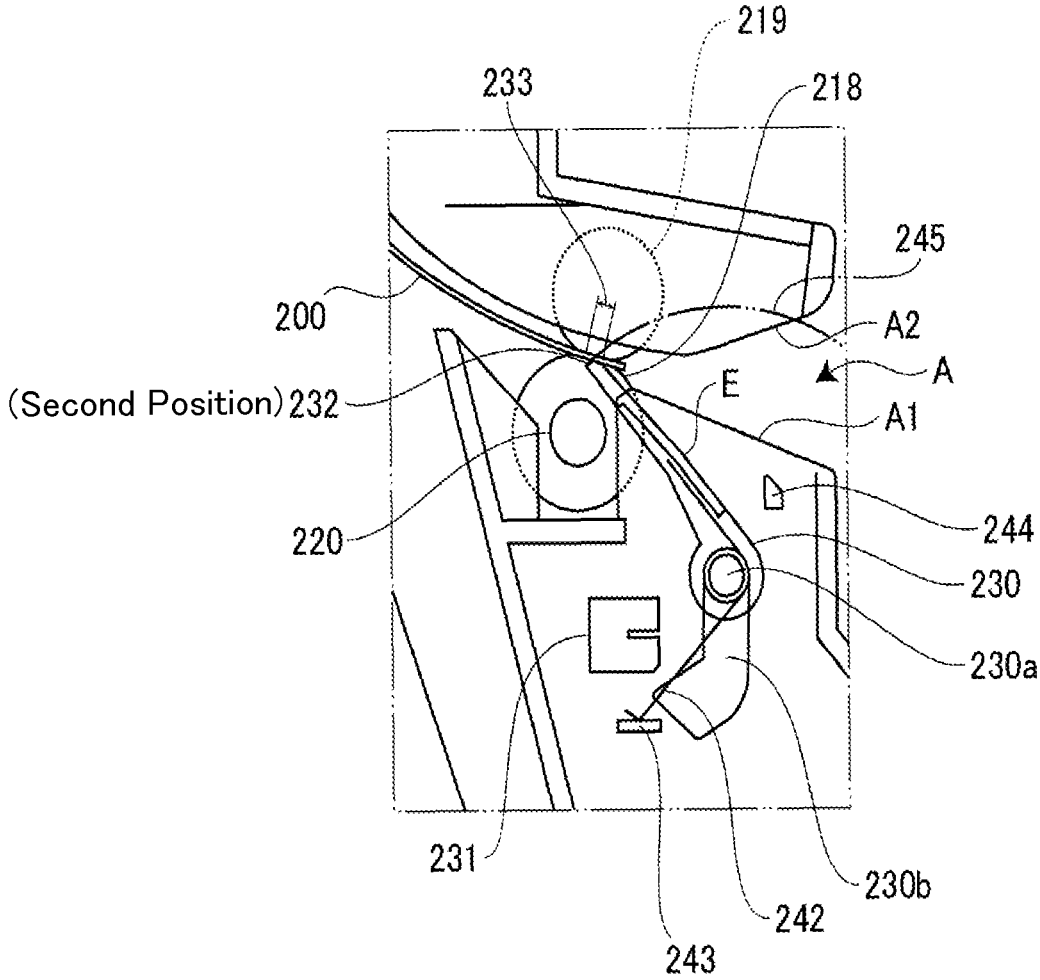
FIG. 5 is a partially enlarged view that explains a configuration of the sensor lever.

FIG. 5 is a partially enlarged view that explains a configuration of the sensor lever 230, and is a view of a vicinity of the sheet ejection unit 206 in a state where the sheet 200 is being carried, the view seen from the rotation axial direction of the sheet ejection roller 218. Starting with the situation illustrated in FIG. 4, the sheet 200 is carried, the direct contact part E of the sensor lever 230 directly contacts the sheet 200, the sensor lever 230 pivots so that the shielding part 230*b* moves to the position where the photocoupler 231 is not shielded, and the sheet detection by the photocoupler 231 is turned on. After that, from the situation illustrated in FIG. 5, furthermore, the sheet 200 is carried along the medium carrying path S and are carried to the downstream side of the tip end part 232 of the sensor lever 230, and the tip end part 232 of the sensor lever 230 moves back to the position illustrated in FIG. 4 due to bias force of the torsion spring 242. At this time, because the shielding part 230*b* of the sensor lever 230 shields the photocoupler 231, the sheet detection by the photocoupler 231 is turned off.

As described above, a timing after transiting from the situation of FIG. 4 (photocoupler 231: off) to the situation in FIG. 5 (photocoupler 231: on) and then transiting back again to the situation of FIG. 4 (photocoupler 231: off) is a timing to detect a rear end of the sheet 200. Herein, the situation that the tip end part 232 formed in the sensor lever 230 as the medium detection member passes through the nip part 233 means a situation that the tip end part 232 of the sensor lever 230 passes through between the direct contact part B and the direct contact part C as drawing a pivoting path 245 when the sheet 200 directly contacts and the sensor lever 230 pivots around the pivoting fulcrum 230*a* as the center.

Herein, when the medium detection member does not detect the sheet passing through the sensing area, the sensor lever position is defined at the first position. The position is illustrated in FIG. 4. On the other hand, C position in FIG. 4, where the rear end of the sheet is about to be separated from the sensor lever, is defined as the second position. In the embodiment, the sensor is OFF at the first position, and OFF at the second position. However, in another embodiment, the sensor may be ON at the first position and ON at the second position.

Next, an operation according to the present embodiment including the above-described configuration is explained.

When a control command related to printing execution and image data are input from a host device such as a personal computer, for example, a photoreceptor 211 starts to rotate at a predetermined peripheral speed. Simultaneously, a charger 213 applies a predetermined bias voltage to the photoreceptor 211, and the entire surface of the photoreceptor 211 is evenly charged. Then, the optical unit 214 radiates light based on input image data and forms electrostatic latent image on the photoreceptor 211. The development unit 212 develops a toner image by adhering toner to an electrostatic latent image part using line of electric force corresponding to the electrostatic latent image formed on the photoreceptor 211.

As synchronizing the operation of forming the above described toner image, the sheet supply unit 202 supplies the sheets 200 one by one from the uppermost part of the sheets 200 contained in the sheet supply cassette 201 to the medium carrying path S. Then, the carrying roller 238 and the carrying roller 239 correct the skew of each of the sheets 200 fed from the sheet supply unit 202, and hold and carry the sheet 200 to the image forming part 203.

To the sheet 200 carried to the image forming part 203, a toner image formed on the surface of the photoreceptor 211 is transferred by the transferring roller 204 to which an application voltage is applied from a high voltage power source (not illustrated).

After that, the sheet 200 is carried to the fusion unit 205. Then, the toner is melted by heat applied from the heat roller 241, and furthermore the toner image is fused on the sheet 200 by being contacted and pressed between the heat roller 241 and the back-up roller 240.

Figure 6:
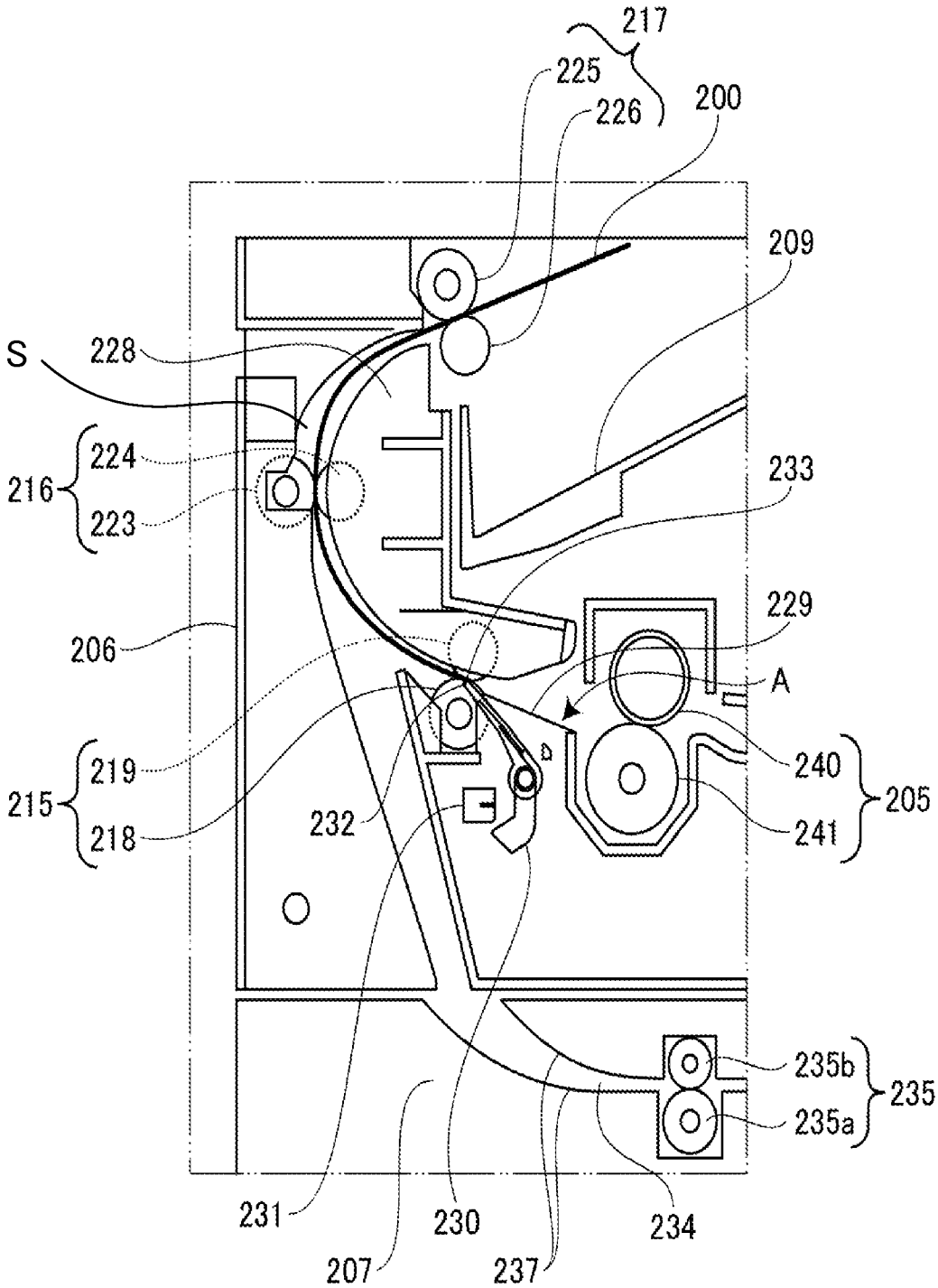
FIG. 6 is a view that explains a condition of sheet carrying by the sheet ejection unit.
Figure 7:
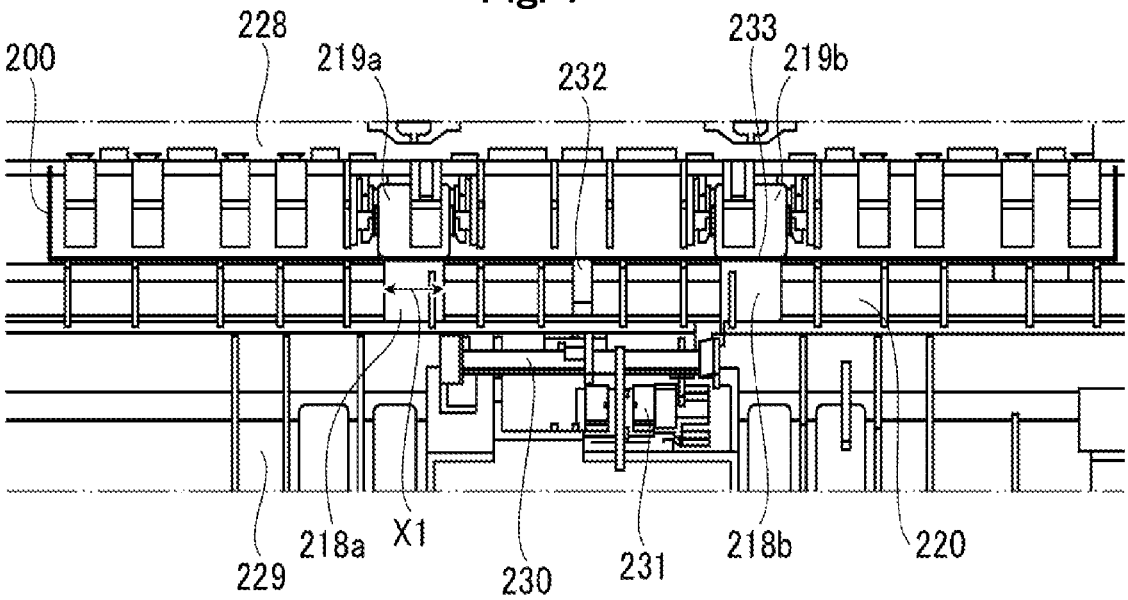
FIG. 7 is a view that explains a condition of sheet carrying by the sheet ejection unit.

The sheet 200 on which the toner image is fused is ejected by the ejection unit 206 to the sheet stacking part 209 formed using the outside of the case of the apparatus main body 208. In other words, as the status views illustrated in FIGS. 6 and 7, a front end part of the sheet 200 is carried to the pair of sheet ejection rollers 215 in response to the rotation of the rollers of the fusion unit 205 as being directly contacted to the direct contact part E of the sensor lever 230. The sensor lever 230 starts to pivot and the shielding part 230*b* moves to a position where the shielding part 230*b* doesn't shield the photocoupler 231, and then the sheet detection by the photocoupler 231 is turned on. Then, the sheet 200 is carried by the pair of sheet ejection rollers 215, the pair of sheet ejection rollers 216, and the pair of sheet ejection rollers 217 along the medium carrying path S. When the rear end of the sheet 200 is carried to the downstream side along the medium carrying path S with respect to the tip end part 232 of the sensor lever 230, the tip end part 232 of the sensor lever 230 moves back to the position illustrated in FIG. 4 by the bias force of the torsion spring 242. At this time, the shielding part 230*b* of the sensor lever 230 shields the photocoupler 231, so that the sheet detection by the photocoupler is turned off.

The detection by the sensor lever 230 of the front end part and the rear end part of the sheet 200 may be used as a trigger signal for rotation start and rotation end of the pairs of sheet ejection rollers and a trigger signal for rotation start of the pair of sheet ejection rollers to rotate in a reverse direction as well for a case of both side printing, which is described hereinafter.

In the case of both side printing, the rear end of the sheet 200 is carried to the downstream side along the medium carrying path S with respect to the tip end part 232 of the sensor lever 230, the sheet detection by the photocoupler 231 is turned off, the sheet 200 is carried for a certain distance, and after those, the pair of sheet ejection rollers 216 and the pair of sheet ejection rollers 217 start to rotate in the reverse direction. In response to the rotation of the pair of sheet ejection rollers 216 and the pair of sheet ejection rollers 217 in the reverse direction, the sheet 200 is sent to the inversion path 234. The sheet 200 sent to the inversion path 234 is carried along the carrying guide 237 in response to the rotation of the pair of the both side carrying rollers 235 and the pair of both side carrying rollers 236 that are included by the both side carrying unit 207. Then, the sheet 200 of which upper surface is a surface on which the toner image is formed is reversed just before the sheet 200 reaches the carrying roller 239 such that the upper and bottom surfaces are reversed, and the sheet 200 is again carried to the image forming part 203 in a state where the surface thereof on which the toner image is formed serves as the bottom surface thereof.

A toner image formed on the surface of the photoreceptor 211 is transferred to the sheet 200 carried again to the image forming part 203 by the transferring roller 204. After that, the sheet 200 is carried to the fusion unit 205. Then, the toner is melted by heat applied by the heat roller 241, and the toner image is fused onto the sheet 200 by being contacted and pressed between the heat roller 241 and back-up roller 240.

The sheet 200 that toner images are fused on its both sides is ejected by the sheet ejection unit 206 to the sheet stacking part 209 formed using the outside of the case of the apparatus main body 208, and a serious of the printing operations ends.

Figure 8:
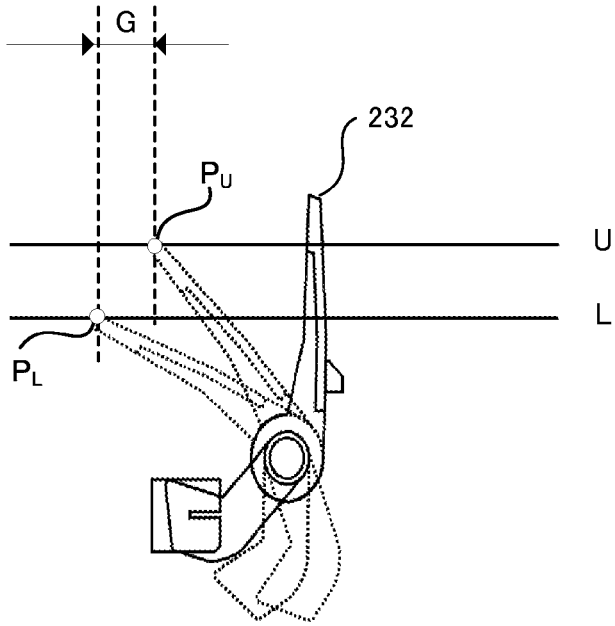
Fig. 8 RELATED ART
FIG. 8 is a view that explains a driving condition of a sensor lever according to a conventional art.

As described above, according to the first embodiment, the position where the tip end part of the sensor lever detects the sheet rear end corresponds to the position of the nip part of the pair of sheet ejection rollers, so that the variation of the position where the sheet rear end passes the sensor lever can be suppressed. In other words, in the related art illustrated in FIG. 8, depending a condition of the sheet, the position at which the sheet rear end passes the sensor lever varies, and as the result there has been a problem that the accuracy of the sheet rear end detection is low. For example, when a sheet passes at upper level U, the sheet rear end is separated from the tip end part 232 of the sensor lever 230 at point $P_U$. On the other hand, when the sheet passes at lower level L, the sheet rear end is separated at point $P_L$. Comparing the positions of $P_U$ and $P_L$, there is gap G in the medium carrying direction, making the accuracy of the sensor low. However, according to the first embodiment of the present invention, it is possible to increase the accuracy of the sheet rear end detection, its throughput is stabilized, and it may be able to make the printing speed faster.

Second Embodiment

Figure 9:
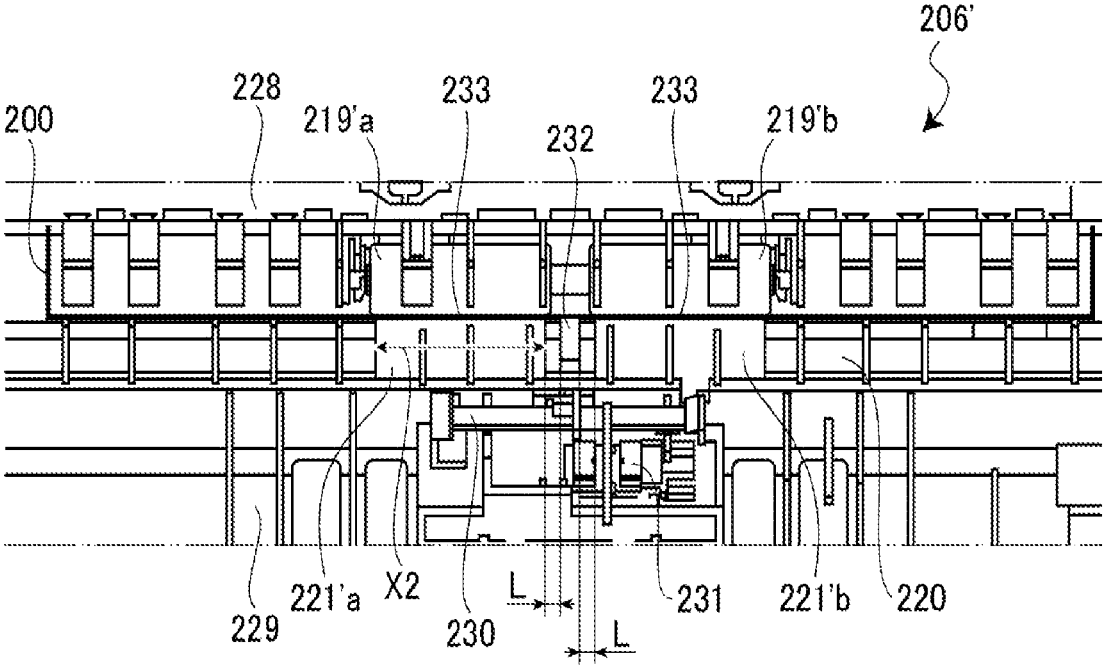
FIG. 9 is a circumferential view of one portion of the sheet ejection unit, seen from the Q-Q direction of FIG. 2.

A configuration of a sheet ejection unit 206' according to a second embodiment is explained referring to FIG. 9. FIG. 9 is a circumferential view of one portion of the sheet ejection unit 206', seen from the Q-Q direction of FIG. 2.

The sheet ejection unit 206' according to the second embodiment includes a pair of sheet ejection rollers 215' that includes a roller 221'*a* and a roller 221'*b*. A length of a roller 221'*a* (corresponding to X2 in the figure) and a length of a roller 221'*b* are respectively longer than the length (X1) in the longitudinal direction of the roller 218*a* and the length in the longitudinal direction of the roller 218*b*. Then, the pair of sheet ejection rollers 215' includes a pressure application roller 219' and a pressure application roller 219'*b*. The pressure application roller 219' has a length in the longitudinal direction the same as that of the roller 221'*a*, and the pressure application roller 219'*b* has a length in the longitudinal direction the same as that of the roller 221'*b*. In other words, in the present embodiment, distances L from the roller 221'*a* and the roller 221'*b* to the sensor lever 230 are configured to be shorter in comparison with the first embodiment. The other configurations can be configured to have the configurations the same as the first embodiment, so that the same reference numbers are given, and its explanations are omitted.

Next, operations according to the present embodiment that includes the above-described configuration are explained.

Upon the input of a control command and image data related to printing execution from the host device such as a personal computer, for example, the photoreceptor 211 starts to rotate at a predetermined rotation speed. Simultaneously, the charger 213 applies a predetermined bias voltage to the photoreceptor 211 and charges evenly the entire surface of the photoreceptor 211. Then, the optical unit 214 radiates light based on the input image data and forms an electrostatic latent image on the photoreceptor 211. The development unit 212 develops a toner image by adhering toner to an electrostatic latent image part using line of electric force corresponding to the electrostatic latent image formed on the photoreceptor 211

As synchronizing the operation of forming the above described toner image, the sheet supply unit 202 supplies the sheets 200 one by one from the uppermost part of the sheets 200 contained in the sheet supply cassette 201 to the medium carrying path S. Then, the carrying roller 238 and the carrying roller 239 correct the skew of each of the sheets 200 fed from the sheet supply unit 202, and hold and carry the sheet 200 to the image forming part 203.

To the sheet 200 carried to the image forming part 203, a toner image formed on the surface of the photoreceptor 211 is transferred by the transferring roller 204 to which an application voltage is applied from a high voltage power source (not illustrated).

After that, the sheet 200 is carried to the fusion unit 205. Then, the toner is melted by heat applied from the heat roller 241, and furthermore the toner image is fused on the sheet 200 by being contacted and pressed between the heat roller 241 and the back-up roller 240.

The sheet 200 on which the toner image is fused is ejected by the ejection unit 206' to the sheet stacking part 209 formed using the outside of the case of the apparatus main body 208. In other words, as the status views illustrated in FIGS. 6 and 7, a front end part of the sheet 200 is carried to the pair of sheet ejection rollers 215' in response to the rotation of the rollers of the fusion unit 205 as being directly contacted to the direct contact part E of the sensor lever 230. The sensor lever 230 starts to pivot and the shielding part 230*b* moves to a position where the shielding part 230*b* doesn't shield the photocoupler 231, and then the sheet detection by the photocoupler 231 is turned on. Then, the sheet 200 is carried by the pair of sheet ejection rollers 215', the pair of sheet ejection rollers 216, and the pair of sheet ejection rollers 217 along the medium carrying path S. When the rear end of the sheet 200 is carried to the downstream side along the medium carrying path S with respect to the tip end part 232 of the sensor lever 230, the tip end part 232 of the sensor lever 230 moves back to the position illustrated in FIG. 4 by the bias force of the torsion spring 242. At this time, the shielding part 230*b* of the sensor lever 230 shields the photocoupler 231, so that the sheet detection by the photocoupler is turned off.

The detection by the sensor lever 230 of the front end part and the rear end part of the sheet 200 may be used as a trigger signal for rotation start and rotation end of the pairs of sheet ejection rollers and a trigger signal for rotation start of the pair of sheet ejection rollers to rotate in a reverse direction as well for a case of both side printing, which is described hereinafter.

In the case of both side printing, the rear end of the sheet 200 is carried to the downstream side along the medium carrying path S with respect to the tip end part 232 of the sensor lever 230, the sheet detection by the photocoupler 231 is turned off, the sheet 200 is carried for a certain distance, and after those, the pair of sheet ejection rollers 216 and the pair of sheet ejection rollers 217 start to rotate in the reverse direction. In response to the rotation of the pair of sheet ejection rollers 216 and the pair of sheet ejection rollers 217 in the reverse direction, the sheet 200 is sent to the inversion path 234. The sheet 200 sent to the inversion path 234 is carried along the carrying guide 237 in response to the rotation of the pair of the both side carrying rollers 235 and the pair of both side carrying rollers 236 that are included by the both side carrying unit 207. Then, the sheet 200 of which upper surface is a surface on which the toner image is formed is reversed just before the sheet 200 reaches the carrying roller 239 such that the upper and bottom surfaces are reversed, and the sheet 200 is again carried to the image forming part 203 in a state where the surface thereof on which the toner image is formed serves as the bottom surface thereof.

A toner image formed on the surface of the photoreceptor 211 is transferred to the sheet 200 carried again to the image forming part 203 by the transferring roller 204. After that, the sheet 200 is carried to the fusion unit 205. Then, the toner is melted by heat applied by the heat roller 241, and the toner image is fused onto the sheet 200 by being contacted and pressed between the heat roller 241 and back-up roller 240.

The sheet 200 that toner images are fused on its both sides is ejected by the sheet ejection unit 206 to the sheet stacking part 209 formed using the outside of the case of the apparatus main body 208, and a serious of the printing operations ends.

As described above, according to the second embodiment, the distances L from the roller 221'*a* and the roller 221'*b* to the sensor lever 230 are configured to be shorter in comparison with the first embodiment, so that slack in the sheet 200 can be reduced, and the variation of the position where the sheet rear end passes the sensor lever can be suppressed.

In the explanation of the embodiments of the present invention, an example is used in which the invention is applied to an image forming apparatus that directly transfers a toner image to a sheet. However, the present invention is not limited to this, and is also applicable to an apparatus that performs image processing to a carried sheet such as a color image forming apparatus using a middle transferring belt, a plural colors image forming apparatus using a plurality of process units as image forming parts, a photocopier and automatic document reading apparatus using those, and the like. Also, the present invention is not limited to the image forming apparatus, and is applicable to medium supplying part as well.

What it claimed is:

1. A medium carrying device, comprising:

a first pair of rollers that forms a nip part and carries a medium, the nip part being defined as an area where the rollers contact each other applying a pressure to the other;

a guide part that guides the medium to the first pair of rollers; and a medium detection member that includes a tip end part and a pivoting fulcrum and that is pivoted around the pivoting fulcrum by the medium as the medium moves along the guide part, wherein in a case of being viewed from a roller axial direction of the first pair of rollers, the tip end part passes the nip part when the medium detection member pivots around the pivoting fulcrum as a center;

the medium detection member is configured to detect whether or not the medium is present in the guide part and to output a detection result, the medium carrying device, further comprising:

a second pair of rollers arranged on a downstream side of the first pair of rollers in a medium carrying direction; and a controller unit that controls rotation of the first pair of rollers and the second pair of rollers based on a detection result of the medium detection member;

the medium detection member; detects a rear end of the medium, and the controller unit reverses a rotation direction of the second pair of rollers after the rear end of the medium is detected by the medium detection member and a predetermined period of time passes.

2. The medium carrying device according to claim 1, wherein the first pair of rollers consists of at least two of the first pairs of rollers arranged in the roller axial direction, and the medium detection member is arranged between the first pairs of rollers in the roller axial direction.

3. The medium carrying device according to claim 1, wherein the first pair of rollers is configured with a first roller and a second roller of which surface is made of material that is softer than that of the first roller, and the pivoting fulcrum of the medium detection member is arranged in the second roller side.

4. The medium carrying device according to claim 1, wherein the first pair of rollers is configured with a first roller and a second roller of which Young's modulus is lower than that of the first roller, and the pivoting fulcrum of the medium detection member is arranged in the second roller side.

5. The medium carrying device according to claim 1, wherein the tip end part of the medium detection member moves between a first position and a second position, the first position at which the medium passing through the guide part makes a first contact to the medium detection member, the second position at which the medium detection member is fully pivoted by the medium so that the medium detection member does not move further by being pushing by the medium, and the rear end of the medium is determined as detected when the tip end part of the medium detection member starts moving from the second position toward the first position.

6. The medium carrying device according to claim 1, further comprising:

a medium detection sensor that detects a medium state whether the medium is present or not-present in the guide part according to a pivotal position of the medium detection member.

7. A medium carrying device, comprising:

a first pair of rollers that forms a nip part and carries a medium, the nip part being defined as an area where the rollers contact each other applying a pressure to the other;

a guide part that guides the medium to the first pair of rollers; and a medium detection member that includes a tip end part and a pivoting fulcrum and that is pivoted around the pivoting fulcrum by the medium as the medium moves along the guide part, wherein a medium detection sensor that detects a medium state whether the medium is present or not-present according to a pivotal position of the medium detection member, wherein the tip end part of the medium detection member moves between a first position and a second position, the first position at which the medium passing through the guide part makes a first contact to the medium detection member, the second position at which the medium detection member is fully pivoted by the medium so that the medium detection member does not move further by being pushed by the medium, in a case of being viewed from a roller axial direction of the first pair of rollers, the tip end part of the medium detection member at the second position is ranged within the nip part.

8. An image forming apparatus, comprising:

an image forming part that forms an image to a medium;

a first pair of rollers that forms a nip part and carries the medium on which the image is formed, the nip part being defined as an area where the rollers contact each other applying a pressure to the other;

a guide part that guides the medium to the first pair of rollers;

a medium detection member that includes a tip end part and a pivoting fulcrum and that is pivoted around the pivoting fulcrum by the medium as directly contacting the medium, and a medium detection sensor that detects a medium state whether the medium is present or not-present according to a pivotal position of the medium detection member, wherein the tip end part of the medium detection member moves between a first position and a second position, the first position at which the medium passing through the guide part makes a first contact to the medium detection member, the second position at which the medium detection member is fully pivoted by the medium so that the medium detection member does not move further by being pushed by the medium;

in a case of being viewed from a roller axial direction of the first pair of rollers, the tip end part of the medium detection member at the second position is ranged within the nip part.

* * * * *